US005724835A

United States Patent [19]

Hine

[11] Patent Number: 5,724,835

[45] Date of Patent: Mar. 10, 1998

[54] AIR SEPARATION

[75] Inventor: Christopher J. Hine, Guildford, England

[73] Assignee: The BOC Group plc, Windlesham, England

[21] Appl. No.: 582,817

[22] Filed: Jan. 4, 1996

[30] Foreign Application Priority Data

Jan. 11, 1995 [GB] United Kingdom ..... 9500514

[51] Int. Cl.[6] ..... F25J 1/00

[52] U.S. Cl. ..... 62/646; 62/924

[58] Field of Search ..... 62/646, 924

[56] References Cited

U.S. PATENT DOCUMENTS 4,433,990 2/1984 Olszewski ..... 62/924

4,871,382 10/1989 Thorogood et al. ..... 62/924

*Primary Examiner*—Ronald C. Capossela

*Attorney, Agent, or Firm*—David M. Rosenblum; Salvatore P. Pace

[57] ABSTRACT

Air is compressed in a compressor, pre-purified in an unit, and cooled in a heat exchanger. The resulting flow of air is subjected to a first rectification in a double rectification column so as to separate the air into an oxygen-rich fraction and a nitrogen-rich fraction. A further oxygen fraction, enriched in argon, is withdrawn from the double rectification column and is introduced into the bottom of a second rectification column in which relatively pure argon is separated from the oxygen. A stream of relatively impure argon is supplied from an independent source to an intermediate region of the second rectification column through an inlet thereof.

5 Claims, 1 Drawing Sheet

AIR SEPARATION

BACKGROUND OF THE INVENTION

This invention relates to air separation.

A well known air separation process comprises compressing a stream of air, pre-purifying the stream of compressed air and cooling it to a temperature suitable for its separation by rectification, subjecting the cooled and purified air stream to a first rectification so as to produce an oxygen-enriched fraction and a nitrogen-enriched fraction, withdrawing an argon-enriched oxygen vapour stream from the first rectification and subjecting it to a second rectification so as to effect a separation as between argon and oxygen and to produce an argon product. The first rectification is typically but not necessarily performed in a double rectification column which comprises a higher pressure rectification column whose top region is in heat exchange relationship with the bottom region of a lower pressure rectification column. The air stream is separated in the higher pressure rectification column into nitrogen vapour and oxygen-enriched liquid air. A feed stream for the lower pressure rectification column is taken from the oxygen-enriched liquid air. The nitrogen vapour is condensed and part of the condensate is used to meet the requirements of the lower pressure rectification column for reflux. The lower pressure rectification column is reboiled by the condensing nitrogen vapour. Oxygen and nitrogen products can therefore be separated in the lower pressure rectification column.

An argon-enriched oxygen vapour stream typically containing from 5 to 15% by volume of argon is withdrawn from an intermediate liquid-vapour contact region of the lower pressure rectification column and introduced into a further rectification column in which the argon is separated. Typically, a crude argon product containing at least 95% by volume of argon and up to about 3% by volume of oxygen with a balance of nitrogen is produced.

Argon and oxygen have similar volatilities. Accordingly, the further rectification column needs to employ quite a large number of distillation stages even to achieve an argon product which is from 95 to 98% pure. It is well known that if one uses conventional distillation trays in the further rectification column it is for practical purposes impossible to reduce the concentration of oxygen in the argon product to less than 10 volumes per million in the further rectification column. Accordingly, in order to produce an argon product of such purity, residual oxygen is conventionally removed by being reacted catalytically with hydrogen to form water vapour, the resulting oxygen-free argon being dried to remove the resulting water vapour and downstream of such drying being further distilled to remove nitrogen and hydrogen impurities.

An improvement to the argon purification process is described in EP-A-0 377 117. In this improvement the further rectification column contains packing in order to effect contact between liquid and vapour. Further, the amount of packing used is sufficient to provide at least 150 theoretical plates (i.e. stages) in the further rectification column. It is reported in EP-A-377 117 that by employing approximately 180 theoretical plates an oxygen content of less than 1 volume per million in the crude argon product of the further rectification column can be achieved with an economically acceptable argon yield.

EP-A-377 117 further discloses separating nitrogen from the crude argon in the yet further rectification column so as to produce a pure argon product. As disclosed in EP-A 0 520 382 very low levels of nitrogen can be achieved in the argon product without resort to this yet further rectification column. Firstly, the nitrogen concentration of the argon-enriched oxygen vapour to the further rectification column can be kept below 50 volumes per million. Secondly, the further rectification column may include an argon-nitrogen separation section above the level of the argon product outlet. Accordingly, the argon product may include less than 10 volumes per million of nitrogen. Thus, if at least 150 theoretical plates are used in the further rectification column (excluding the argon-nitrogen separation) no further purification of the argon product will typically need to be performed.

The key advantage of these improvements is that they eliminate the need for hydrogen, a highly inflammable and explosive gas, to be employed in the vicinity of the air separation plant. There are however in existence a large number of plants with conventional crude argon columns. To replace a conventional crude argon column in an existing plant would require the shutting down of the plant for a prolonged period of time and would be particularly expensive. Since a typical cryogenic air separation plant has an operating life of over twenty years, notwithstanding the advantages offered by the process according to EP-A-377 117, there will still remain a need to employ hydrogen to purify the existing crude argon base load.

It is an aim of the present invention to provide a method and apparatus capable of mitigating the above-described problem.

SUMMARY OF THE INVENTION

According to the present invention there is provided a method of separating air comprising compressing, pre-purifying and cooling air, and subjecting resulting air to a first rectification in which the air is separated into a nitrogen-rich fraction and an oxygen-rich fraction, withdrawing a further oxygen fraction, enriched in argon, from the first rectification, and subjecting the further oxygen fraction to a second rectification in which relatively pure argon is separated from oxygen, and supplying from an independent source to the second rectification a stream of relatively impure argon comprising argon, oxygen and nitrogen.

The invention also provides apparatus for separating air comprising means for compressing, pre-purifying and cooling air, one or more first rectification columns for separating resulting air into a nitrogen-rich fraction and an oxygen-rich fraction having an outlet for a further oxygen fraction, enriched in argon, communicating with a first inlet of a second rectification column or columns for separating relatively pure argon from oxygen, the second rectification column or columns having a second inlet communicating with an independent source of relatively impure argon.

The method and apparatus according to the invention make it possible to produce a relatively pure argon product at a particularly high yield calculated as a percentage of the argon content of the incoming air. Moreover, the method and apparatus according to the invention make it possible to purify at an appreciable rate crude argon produced in a separate apparatus.

The relatively pure argon is typically product at such a purity that it contains less than 10 volumes per million of oxygen impurity.

The relatively impure argon may, for example, have an oxygen content in the range of from 0.5 to 10% by volume of oxygen, typically, in the range of from 1 to 3% by volume of oxygen. In addition, the relatively impure argon typically contains from 50 to 2000 volumes per million of nitrogen.

The relatively impure argon may be supplied to the second rectification from a separate argon rectification column or from a storage vessel in liquid or vapour state. It is conventional to produce such relatively impure argon in liquid state although it can alternatively be produced in vapour state. If the relatively impure argon is produced in liquid state, it is preferably vaporised upstream of its introduction into the second rectification. Preferably, such vaporisation is performed by indirect heat exchange with another stream employed in the method according to the invention. Such vaporisation helps to improve the overall rate of production and yield of argon product.

The additional fluid traffic in the second rectification that arises from the separation of the impure argon in addition to the argon-enriched oxygen in the second rectification has the effect of reducing the L/V (liquid/vapour) ratio within the column. There thus tends to be a low conversion of the impure argon to relatively pure argon product having a given concentration of oxygen impurity. To improve the conversion of impure argon the second rectification may be operated at a substantially unchanged L/V ratio by the effect of increasing the flow of the further oxygen fraction to the second separation. Alternatively, or in addition, the second rectification may be performed with an increased height of packing (or number of theoretical trays) to give an improved conversion of impure argon to relatively pure argon product having a given concentration of oxygen impurity.

The argon-enriched oxygen stream may be introduced into the second rectification in vapour or liquid state. If introduced in liquid state, the second rectification column may be provided with a reboiler to create the necessary vapour flow up the column.

Any convenient means may be employed to provide reflux for the second rectification column. In the event that the first rectification is performed in a double rectification comprising a higher pressure stage and a lower pressure stage, said relatively pure argon is preferably condensed by indirect heat exchange with a stream of oxygen-enriched liquid air withdrawn from said higher pressure stage.

BRIEF DESCRIPTION OF THE DRAWINGS

The method and apparatus according to the invention will now be described by way of example with reference to the accompanying drawing which is a schematic flow diagram of an air separation plant.

The drawing is not to scale.

DETAILED DESCRIPTION

Figure 1:
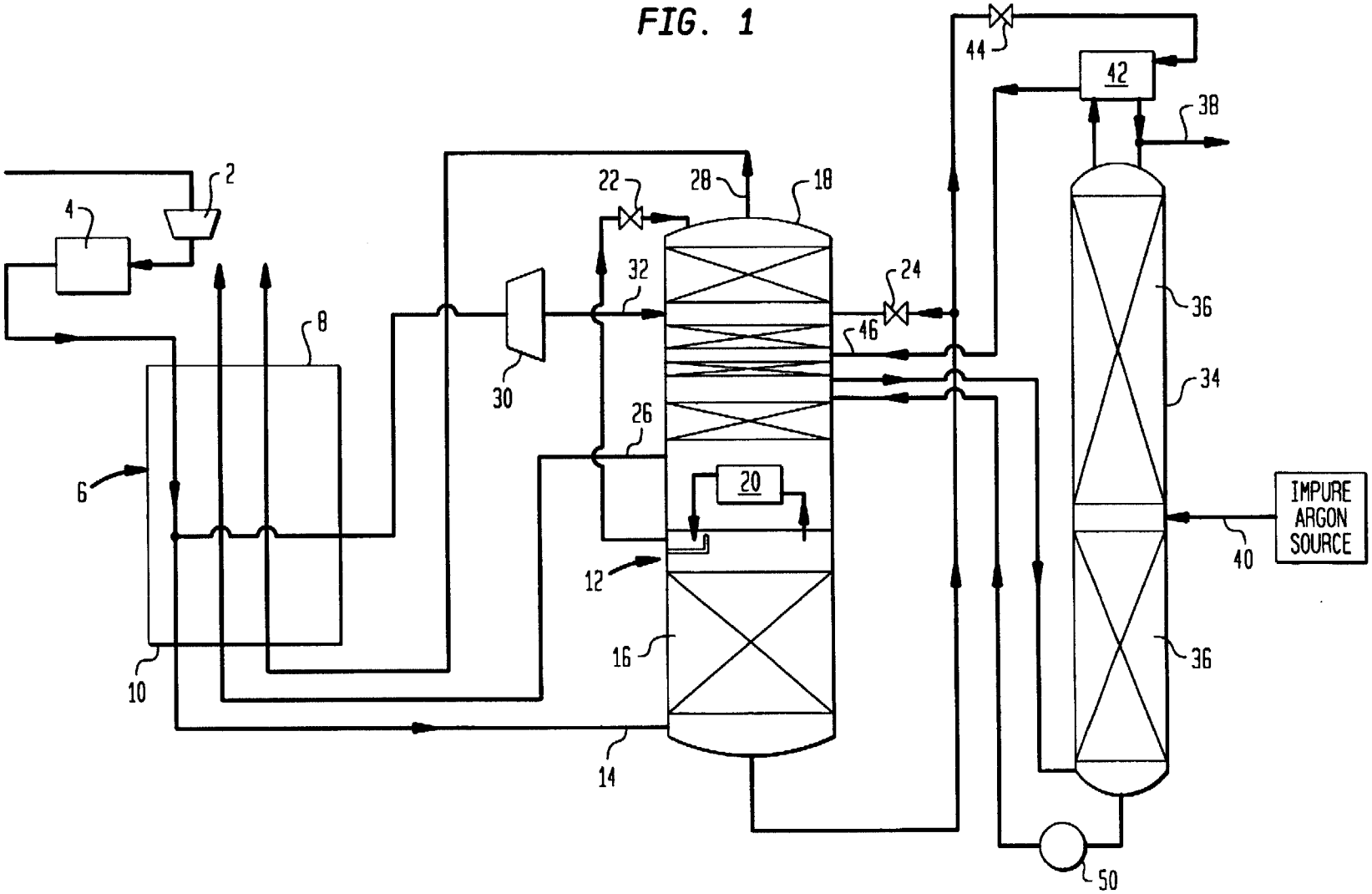

Referring to the drawing, a stream of air is compressed in a compressor 2 typically to a pressure in the range of 5 to 6 bar. The stream of compressed air is subjected to treatment to pre-purify it, by which is meant the removal of relatively low volatility components, particularly water vapour and carbon dioxide, therefrom. In addition, the air is cooled to a temperature suitable for its separation by rectification. As shown in the drawing, the pre-purification is performed by passing the compressed air stream through a purification unit 4 effective to remove water vapour and carbon dioxide therefrom. The unit 4 employs beds (not shown) of adsorbent to effect this removal of water vapour and carbon dioxide. The beds are operated so that the purification is performed continuously. Regeneration of the beds may be performed by purging them with a stream of hot nitrogen. Such purification units and their operation are well known in the art and need not be described further. The purified air is then cooled to a temperature suitable for its rectification by passage through a main heat exchanger 6 from its warm end 8 to its cold end 10. If desired, as an alternative to the purification unit 4, the main heat exchanger 6 may be a reversing heat exchanger which is effective to freeze out and hence remove water vapour and carbon dioxide impurities from the air as it flows therethrough.

The compressed, pre-purified and cooled air flows from the cold end 10 of the main heat exchanger 6 into a rectification column 12 through an inlet 14. The rectification column 12 takes the form of a double rectification column comprising a higher pressure column 16 and a lower pressure column 18. The top of the higher pressure column 16 is placed in heat exchange relationship with the bottom of the lower pressure column 18 by a condenser-reboiler 20. The rectification column 12 is operated so as to perform a first rectification in which the incoming air is separated into nitrogen and oxygen products. Instead of a double rectification column it is possible to use a single rectification column (not shown) as for example illustrated in GB-A-1 258 568. Another alternative is to use a system of three distillation columns all at different pressures from one another to perform the first rectification. (See, for example, EP-A-538 118.)

The higher pressure rectification column 16 employs either liquid-vapour contact trays (for example, sieve trays) or packing in order to effect contact therein between a rising vapour phase and a descending liquid phase. Nitrogen is separated from the air in the higher pressure column 16. Nitrogen vapour flows from the top of the higher pressure column 16 and is condensed in condensing passages of the condenser-reboiler 20. Part of the resulting condensate is used as reflux in the higher pressure column 16. Another part of the liquid nitrogen flow is passed through a throttling valve 22 and is introduced into the top of the lower pressure column 18 of the double rectification column 12 and acts as reflux in the lower pressure column. If desired this other part of the liquid nitrogen flow may be sub-cooled upstream of the throttling valve 22.

An oxygen-enriched liquid stream is withdrawn from the bottom of the higher pressure column 16, and is divided into two subsidiary streams. One subsidiary stream is passed through a throttling valve 24 and is introduced into the lower pressure rectification column 18 at an intermediate region thereof. As will be discussed below, the second subsidiary stream is used to cool an argon condenser. If desired, the oxygen-enriched liquid stream may be sub-cooled upstream of its division into two subsidiary streams.

The lower pressure column 18 of the double rectification column 12 typically contains packing or liquid-vapour contact trays in order to effect intimate contact between an ascending vapour phase and a descending liquid phase. Liquid collecting at the bottom of the column 18 is boiled in boiling passages of the condenser-reboiler 20 in indirect heat exchange relationship with condensing nitrogen. An ascending flow of vapour through the column 18 is thereby created. An oxygen-rich product (typically containing at least 99% by volume of oxygen) is withdrawn in vapour state from the column 18 through an outlet 26. A gaseous nitrogen product, typically essentially pure, is withdrawn through an outlet 28 from the top of the lower pressure column 18 of the double rectification column 12. Both the oxygen and nitrogen products are returned through the main heat exchanger 6 from its cold end 10 to its warm end 8 and provide cooling for the incoming air. If the oxygen-enriched liquid and liquid nitrogen streams are to be sub-cooled, this may be effected by their indirect heat exchange in a separate heat exchanger (not shown) with the nitrogen product stream upstream of its flow through the main heat exchanger 6.

In order to create refrigeration for the process a part of the compressed air stream is taken from an intermediate region of the main heat exchanger 6 and is expanded with the performance of external work in an expansion turbine 30. The resultant expanded air stream leaves the turbine 30 at a temperature suitable for its rectification in the lower pressure column 18 of the double rectification column 12. The expanded air stream is supplied to the column 18 through an inlet 32 and is separated in the column 18.

The lower pressure column 18 of the double rectification column 12 is operated at a pressure typically in the range of 1.2 to 1.5 bar or less at its bottom. At such pressures, a maximum argon concentration in the vapour phase in the order of 15% may be achieved at an intermediate level of the column 18. An argon-enriched oxygen vapour stream is withdrawn from a selected level of the lower pressure column 18 of the rectification column 12 and is passed into the bottom of a further rectification column 34 for performing the second rectification, i.e. to separate argon from oxygen. The argon-enriched oxygen vapour typically contains from 5 to 15% by volume of argon. In addition, it typically contains from 20 to 100 volumes per million of nitrogen. The amount of nitrogen impurity depends in part on the height of packing or the number of trays in the lower pressure column 18 above the level from which the argon-enriched oxygen vapour stream is withdrawn. The greater this height of packing or number of liquid-vapour contact trays, the lower the level of nitrogen impurity in the argon-enriched oxygen vapour.

The argon rectification column 34 contains structured or random packing 36 in order to contact ascending vapour with a descending liquid. The height of packing 36 employed in the argon rectification column 34 depends in part on the oxygen content of the relatively pure argon product that is produced.

A crude argon stream is introduced into the argon rectification column 34 at an intermediate level thereof through an inlet 40. In one example, the crude argon stream contains about 98% by volume of argon, about 2% by volume of oxygen, and 2000 parts per million by volume of nitrogen. The crude argon stream may be supplied directly from the crude argon column (not shown) of another air separation plant or from a crude argon storage tank (not shown). The crude argon is preferably vaporised upstream of its introduction into the column 34. The vaporisation may for example be effected by indirect heat exchange with a process stream that is being sub-cooled; for example, if the oxygen-enriched liquid stream withdrawn from the higher pressure rectification column 16 is sub-cooled, the crude argon stream may assist in the sub-cooling.

The inlet 40 is preferably located such that the crude argon stream, if vapour, is introduced into a vapour within the column 34 that has essentially the same argon and oxygen concentrations as the crude argon stream itself, or, if liquid, is introduced into a liquid within the column 34 that has essentially the same argon or oxygen concentrations as the crude argon stream itself.

Reflux for the argon column 34 is provided by condensing argon vapour at the head of the column 34 in a condenser 42. Cooling for the condenser 42 is provided by the other part of the aforesaid oxygen-enriched liquid stream. This stream is passed through a throttling valve 44 upstream of the condenser 42. The oxygen-enriched liquid stream that flows through the condenser 42 is vaporised by the condensing argon and the resulting vapour is introduced into the lower pressure column 18 of the rectification column 12 through an inlet 46. A part of the condensate from the condenser 42 is used as reflux in the argon column 34 while the rest of it is taken as product through the outlet 38. Liquid may be returned from the bottom of the argon column 34 by means of a pump 50 to the low pressure column 18 of the rectification column 12.

The introduction of the crude argon stream into the argon rectification column 34 tends to increase the condensation duty on the condenser 42. This increased duty may be met at least in part by increasing the proportion of the oxygen-enriched liquid air withdrawn from the bottom of the higher pressure column 16 of the double rectification column 12 that is passed through the throttling valve 44. It may also be met in part by vaporising the crude argon liquid in indirect heat exchange with the oxygen-enriched liquid air so as to enhance the degree of sub-cooling of this liquid air. For maximum yield of argon product however, it will typically be necessary to provide an additional source of refrigeration to meet the refrigeration duty necessary to increase the L/V ratio. (If this additional refrigeration is provided by increasing the oxygen-enriched liquid air flow through the condenser 42, the consequential increase in vaporised oxygen-enriched liquid air flow into the lower pressure column 18 may need to be compensated for.)

In some air separation processes in which an oxygen product is produced at elevated pressure, at least some of the oxygen product is withdrawn from the lower pressure column 18 of the rectification column 12 and is pumped up to a supply pressure by a pump (not shown). The pressurised liquid oxygen is vaporised by indirect heat exchange in the main heat exchanger 6. In order to operate the main heat exchanger 6 at a reasonably high thermodynamic efficiency in such circumstances a part of the pitied air is boosted in pressure by a compressor (not shown) intermediate the purification unit 4 and the warm end 8 of the heat exchanger 6 and is passed through the heat exchanger 6 in countercurrent heat exchange with the oxygen being vaporised. The air is thereby liquefied. At least a part of such liquid air may be employed to enhance the refrigeration provided to the condenser 42 upstream of being introduced for separation into the rectification column 12.

The number of theoretical plates and the reflux ratio employed above and below the crude argon inlet 40 in the argon rectification column 34 and the diameter of this column 34 may all be selected with a view to striking an optimum balance between capital costs and running costs per unit volume of argon produced. In general, in comparison with the plant shown in the drawing accompanying EP-A-0 377 117, it may be desirable to use a larger diameter argon column 34 so as to accommodate the increase in vapour traffic and to employ fewer theoretical stages for a given product purity and product production rate.

If it is desired to obtain an essentially pure argon product in the outlet 38 of the argon rectification column 34, the argon product withdrawn through the outlet 38 may have nitrogen separated therefrom in a manner analogous to that described in EP-A-0 377 117. Alternatively, the outlet 38 may have a different position from that shown in the accompanying drawing, communicating with a liquid-vapour contact at a level of the argon column 34 below the top such level thereof with an argon-nitrogen separation section being included in the column 34 in a manner analogous to that described in EP-A-0 520 382.

The argon rectification column 34 is typically a relatively tail installation. If desired, it may be split into two columns (not shown) with vapour from the top of one such column flowing to the bottom of the other and liquid being returned to the top of the one column from the bottom of the other. Such an arrangement can be employed to facilitate the introduction of the crude argon stream since it can be introduced into the vapour stream flowing between the two columns.

In another possible modification to the apparatus shown in the drawing, the argon column 34 may be provided with a reboiler at its bottom and its feed taken from the lower pressure column 18 of the double rectification column 12 in liquid state.

In yet another possible modification to the apparatus shown in the drawing, instead of employing oxygen-enriched liquid air from the bottom of the higher pressure column 16 of the double rectification column 12 as a source of the liquid which is employed to cool the argon condenser 42, a stream of liquid may be taken for this purpose directly from the lower pressure column 18.

The method according to the invention is further illustrated by the following examples:

The operation of the argon rectification column 34 was simulated with different numbers of theoretical stages, with a crude argon stream introduced in liquid and in vapour state and with different argon product flow rates.

The results obtained are summarised in the Table below.

TABLE

| Example | AEO[1] Flow[2] | Total Theoretical Plate | CAF[4] Flow[2] Vapour | CAF[4] Flow[2] Liquid | CAF[4] Plate Introduced[5] | Argon Product Flow[2] | Argon Product Purity[6] | Condenser Duty[3] | Top L/V[8] | Recovery from CAF[4,9] % |
|---|---|---|---|---|---|---|---|---|---|---|
| 1. | 1000 | 43 | — | — | — | 32.42 | 1.8% | 67316 | 0.9690 | — |
| 2. | 1000 | 180 | — | — | — | 34.75 | 1 vpm | 67327 | 0.9667 | — |
| 3. | 1000 | 180 | — | 27.00 | 140 | 40.56 | 1 vpm | 67318 | 0.9611 | 21.7% |
| 4. | 1000 | 180 | 27.00 | — | 140 | 41.40 | 1 vpm | 69056 | 0.9613 | 24.9% |
| 5. | 1000 | 240 | — | 27.00 | 200 | 58.81 | 1 vpm | 67333 | 0.9437 | 90.7% |
| 6. | 1000 | 240 | 27.00 | — | 200 | 59.96 | 1 vpm | 69069 | 0.9440 | 95.1% |
| 7. | 1500 | 180 | 27.00 | — | 140 | 59.56 | 1 vpm | 102718 | 0.9626 | 93.4% |

Key:
[1]AEO means argon-enriched oxygen feed to the column 34.
[2]Flow is in units of $sm^3\ hr^{-1}$.
[3]Condenser duty is in units of $kcal\ h^{-1}$.
[4]CAF means crude argon feed to the column 34 from the inlet 40.
[5]Theoretical plates are numbered from the top of the column downwards.
[6]Oxygen concentration by volume in the argon product.
[7]Top L/V is defined as the ratio of liquid to vapour flow rate on the theoretical plate adjacent to the condenser.
[8]This recovery assumes 34.68 $sm^3h^{-1}$ recovery of pure argon from the argon content of the initial air feed to the process.

In the simulations, the argon-enriched oxygen was taken to have a pressure of 1.3 bar, and a composition of 89% by volume of oxygen, 0.01% by volume of nitrogen, balance argon, and the crude argon was taken to have a composition of 98% by volume of argon, 1.8% by volume of oxygen and 0.2% by volume of nitrogen. Whether introduced as vapour or liquid, the crude argon was taken to be at a pressure of 1.275 bar. A simulated argon product oxygen impurity concentration of 1 volume per million was employed in all examples except Example 1.

Example 1 is a comparative simulation of a conventional crude argon rectification column designed with 43 theoretical plates. Example 2 is a comparative simulation of an argon rectification column designed with 180 theoretical stages so as to give an essentially oxygen-free argon product. Examples 3 to 7 illustrate the method according to the invention. It can be appreciated from these examples that introducing a crude argon stream into the argon rectification column enables the rate of production of argon to be increased at constant number of theoretical plates and approximately constant condenser duty (compare, say, Example 2 with Examples 3 and 4); that the size of the increase in argon production increases with increasing number of theoretical plates (compare, say, Examples 3, 4, 5 and 6 with one another); that the size of the increase in argon production is greater if the crude argon is introduced into the argon rectification column in vapour state rather than in liquid state (compare for example, Example 3 with Example 4); that substantial increases in argon production can be achieved at substantially constant argon column condenser duty (compare, for example, Example 5 with Example 3); that increasing the flow of argon-enriched oxygen into the argon rectification column allows a smaller number of theoretical plates to be used to produce a given quantity of argon, but requires a greater condensation duty (compare Examples 4 to 7 with one another); and that high argon recoveries can be achieved (see, in particular, Examples 6 and 7).

I claim:

1. A method of separating air comprising;

compressing, pre-purifying and cooling air;

subjecting resulting air to a first rectification in which the air is separated into a nitrogen-rich fraction and an oxygen-rich fraction;

withdrawing a further oxygen fraction, enriched in argon from the first rectification, and subjecting the further oxygen fraction to a second rectification in which relatively pure argon is separated from oxygen; and supplying from an independent source to an intermediate location of the second rectification a stream of relatively impure argon comprising argon, oxygen and nitrogen.

2. The method as claimed in claim 1, in which the relatively impure argon has an oxygen content in the range of from 0.5 to 10% by volume.

3. The method as claimed in claim 1, in which the relatively impure argon is introduced into the second rectification in liquid state.

4. The method as claimed in claim 1, in which the relatively impure argon is introduced into the second rectification in vapour state.

5. An apparatus for separating air comprising;

means for compressing, pre-purifying and cooling air;

at least one first rectification column for separating resulting air into a nitrogen-rich fraction and an oxygen-rich fraction;

said at least one first rectification column having an outlet for a further oxygen fraction, enriched in argon, communicating with a first inlet of a said at least one second rectification column;

the said at least one second rectification column having a second inlet at an intermediate location thereof communicating with an independent source of relatively impure argon.

* * * * *